US010029358B2

(12) United States Patent
Moore

(10) Patent No.: US 10,029,358 B2
(45) Date of Patent: Jul. 24, 2018

(54) HYDRAULIC HAMMER WITH CLEARANCE CONTROL SYSTEM

(71) Applicant: Caterpillar Inc., Peoria, IL (US)

(72) Inventor: Cody T. Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 438 days.

(21) Appl. No.: 14/940,170

(22) Filed: Nov. 13, 2015

(65) Prior Publication Data

US 2016/0067858 A1 Mar. 10, 2016

(51) Int. Cl.

| | |
|---|---|
| ***B25D 17/11*** | (2006.01) |
| ***B25D 9/00*** | (2006.01) |
| ***E02F 3/96*** | (2006.01) |

(52) U.S. Cl.

CPC ..... *B25D 17/11* (2013.01); *E02F 3/966* (2013.01); *B25D 2250/121* (2013.01)

(58) Field of Classification Search

CPC .... B25D 17/11; B25D 2250/121; E02F 3/966
USPC ..... 173/90
See application file for complete search history.

(56) References Cited

U.S. PATENT DOCUMENTS

| | | | | |
|---|---|---|---|---|
| 4,450,921 | A | 5/1984 | Arvidsson et al. | |
| 5,285,858 | A * | 2/1994 | Okada | E02F 3/966 173/162.1 |
| 6,095,257 | A * | 8/2000 | Lee | B25D 17/24 173/162.1 |
| 7,628,222 | B2 | 12/2009 | Yoshimura et al. | |
| 8,672,052 | B2 | 3/2014 | Nickels et al. | |

* cited by examiner

*Primary Examiner* — Robert Long
*Assistant Examiner* — Xavier A Madison

(57) ABSTRACT

A clearance control system for a hydraulic hammer is disclosed. The hydraulic hammer includes a housing member, a power cell disposed within the housing member, a wear member disposed between the housing member and the power cell, and a clearance control system for controlling the predefined clearance between the wear member and the power cell. The clearance control system includes a mounting boss and a fastening member disposed on the mounting boss. A first end of the fastening member is configured to receive an input from an operator and the second end is configured to contact with the first surface of the wear member. The fastening member is configured to move along a central axis defined by a threaded hole of the mounting boss to move the wear member towards the power cell, to control the predefined clearance between the wear member and the power cell.

1 Claim, 4 Drawing Sheets

HYDRAULIC HAMMER WITH CLEARANCE CONTROL SYSTEM

TECHNICAL FIELD

The present disclosure relates to a hydraulic hammer, and more specifically to the hydraulic hammer with a clearance control system for controlling a predefined clearance between a wear member and a power cell of the hydraulic hammer.

BACKGROUND

Hydraulic hammers are used at various work sites for removing material from a work surface, for example, for breaking objects, such as rocks, concrete, asphalt, frozen ground, and other materials. The hydraulic hammers may be mounted on a machine, such as a backhoe, an excavator, a dozer, a loader, a motor grader, or any other earth moving machine. A hydraulic hammer generally includes a housing, one or more wear plates, a power cell, and a tool that extends partially out of the housing.

The power cell is positioned within the housing and coupled with the tool that extends out of the housing. The power cell is operated pneumatically or hydraulically for actuating the tool for performing machining operations on the work surface. The wear plates are disposed between the power cell and the housing. The wear plates prevent the components of the hydraulic hammer from being subjected to wear and abrasion caused due to a continuous relative movement between the housing and the power cell.

However, due to the vibrations created as a result of the continuous movement of the power cell and the tool during a machining operation, the wear plates also experience a wear. Consequently, an undesired clearance is created between the wear plates and the power cell. The clearance can be understood as a gap formed between the wear plates and the power cell due to the wear of the wear plates over a period of time. Such clearance leads to a noisy and unstable operation of the hydraulic hammer. This would demand regular maintenance of the wear plates in order to avoid formation of such clearances. Further, there would be inconvenience associated with continuous maintenance of the wear plates. Moreover, the service life of the wear plates is reduced, which would eventually increase an operational cost of the hydraulic hammer.

U.S. Pat. No. 7,628,222 describes a breaker mounting bracket for mounting a breaker body on a distal end of an arm of a working machine or the like. The breaker mounting bracket includes left and right side plates which are arranged to face each other in an opposed manner. The breaker mounting bracket includes an end plate, which is provided between proximal end portions of both side plates and forms a connecting portion with a distal end of the arm of the working machine. The breaker mounting bracket further includes resilient bodies which come into contact with and support the breaker body and are mounted on inner sides of the left and right side plates and the end plate. However, the breaker mounting bracket includes a higher number of components and is complicated and expensive.

SUMMARY OF THE DISCLOSURE

In one aspect of the present disclosure, a hydraulic hammer is provided. The hydraulic hammer includes a housing member. The hydraulic hammer also includes a power cell disposed within the housing member. The hydraulic hammer includes a wear member disposed between the housing member and the power cell. The wear member includes a first surface and a second surface. The first surface is configured to abut an inner surface of the housing member. The second surface is distal to the first surface, and is configured to abut an outer surface of the power cell. Further, the wear member comprises a thickness extending between the first surface and the second surface. The thickness of the wear member is configured to provide a predefined clearance between the second surface of the wear member and the outer surface of the power cell. The hydraulic hammer also includes a clearance control system disposed on the housing member. The clearance control system is configured to control the predefined clearance between the wear member and the power cell based on the thickness of the wear member. The clearance control system includes a mounting boss disposed on the housing member and includes a threaded hole extending from an outer surface to an inner surface of the mounting boss. The clearance control system also includes a fastening member disposed within the threaded hole of the mounting boss. The fastening member includes a first end and a second end. The first end is configured to receive an input from an operator. The second end is configured to contact with the first surface of the wear member. Further, the fastening member moves along a central axis defined by the threaded hole of the mounting boss to move the wear member towards the power cell, based on the input from the operator, to control the predefined clearance between the wear member and the power cell.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. Any reference to elements in the singular is also to be construed to relate to the plural and vice-versa without limiting the scope of the disclosure to the exact number or type of such elements unless set forth explicitly.

Figure 1:
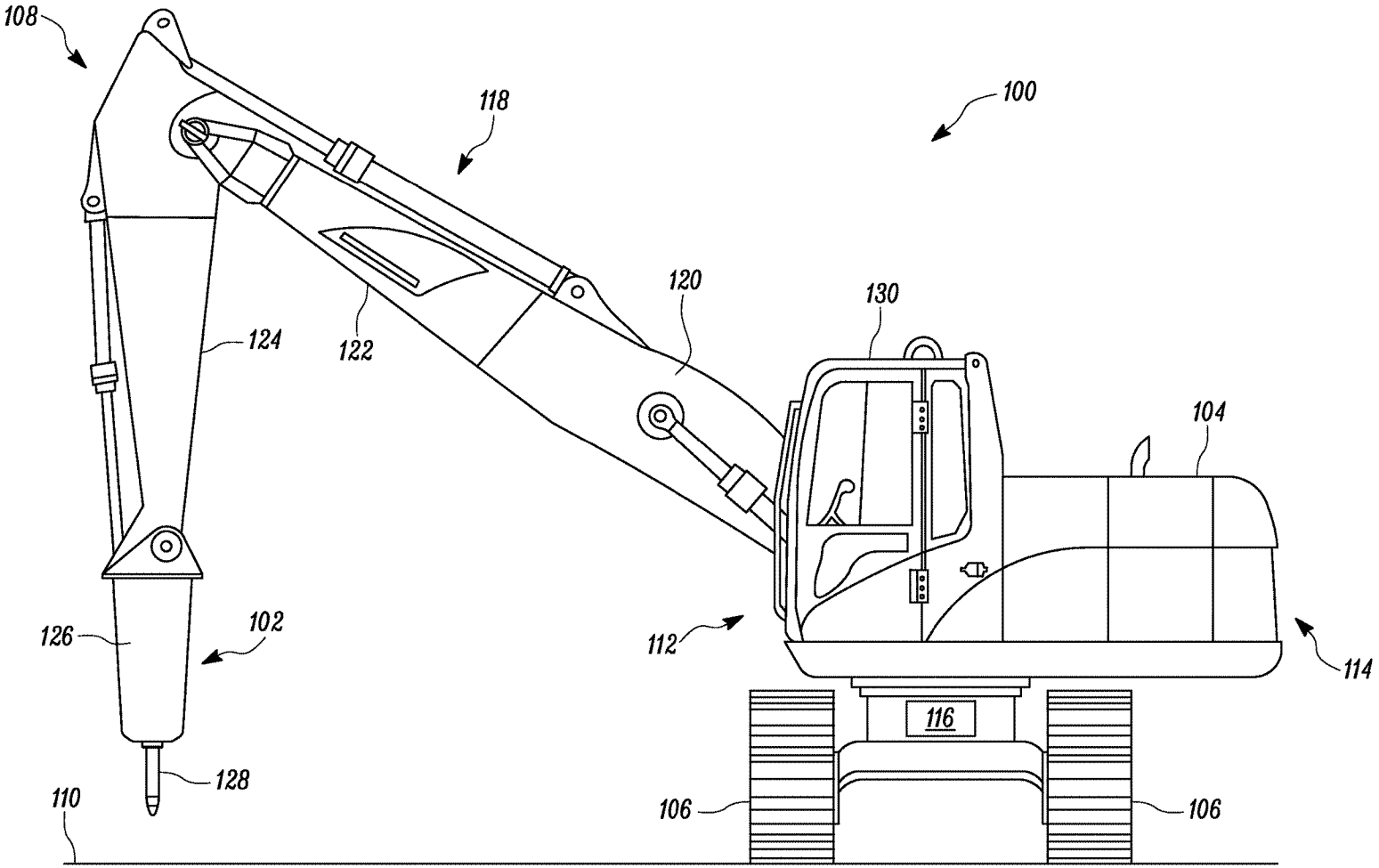
FIG. 1 is a side view of a machine with a hydraulic hammer, in accordance with the concepts of the present disclosure.

FIG. 1 illustrates a side view of a machine 100 with a hydraulic hammer 102, according to one embodiment of the present disclosure. The machine 100 may include, but is not limited to a mobile machine that performs operations associated with an industry, such as mining, construction, farming, transportation, or any other industry known in the art. For example, the machine 100 may be an earth moving machine that may include, but is not limited to a backhoe, an excavator, a dozer, a loader, a motor grader, or any other earth moving machine.

The machine 100 includes a frame 104, a number of ground engaging members 106 for propelling the machine 100, and an implement system 108 configured to move the hydraulic hammer 102 over a work surface 110 for carrying out various earth moving operations. The ground engaging members 106 are in contact with the work surface 110 for moving the machine 100 on the work surface 110. The ground engaging members 106 include a track each at a front end 112 and a rear end 114 of the machine 100.

The machine 100 includes an engine (not shown) enclosed in an engine compartment 116 to provide power to the implement system 108 for moving the hydraulic hammer 102. In an example, the engine may produce a mechanical power output or an electrical power output that may further be converted to a hydraulic power for moving the implement system 108.

The implement system 108 includes a linkage structure 118 connected to the frame 104 of the machine 100 for moving the hydraulic hammer 102. The linkage structure 118 further includes a first linkage member 120, a second linkage member 122 connected to the first linkage member 120, and a third linkage member 124 connected to the second linkage member 122. The third linkage member 124 includes a mounting bracket (not shown) for connecting the hydraulic hammer 102. The mounting bracket is connected to the hydraulic hammer 102 to provide a pivotal movement to the hydraulic hammer 102. The linkage structure 118 is articulated relative to the frame 104 so that orientation and position of the hydraulic hammer 102 may be changed.

The hydraulic hammer 102 includes a housing member 126 configured to attach with the third linkage member 124, a power cell 202 (shown in FIG. 2) disposed within the housing member 126, a number of wear members 204 (shown in FIG. 2) disposed between the housing member 126 and the power cell 202, and a clearance control system 206 (shown in FIG. 2) disposed on the housing member 126 for controlling a predefined clearance C (shown in FIG. 3) between a wear member 204 and the power cell 202. The hydraulic hammer 102 includes a tool 128 for performing a hammering operation on the work surface 110.

The machine 100 further includes an operator station 130 for accommodating the operator to control operations of the machine 100 and the hydraulic hammer 102. The operator station 130 may include a plurality of control equipment (not shown) for the operator to control the operations of the machine 100.

Figure 2:
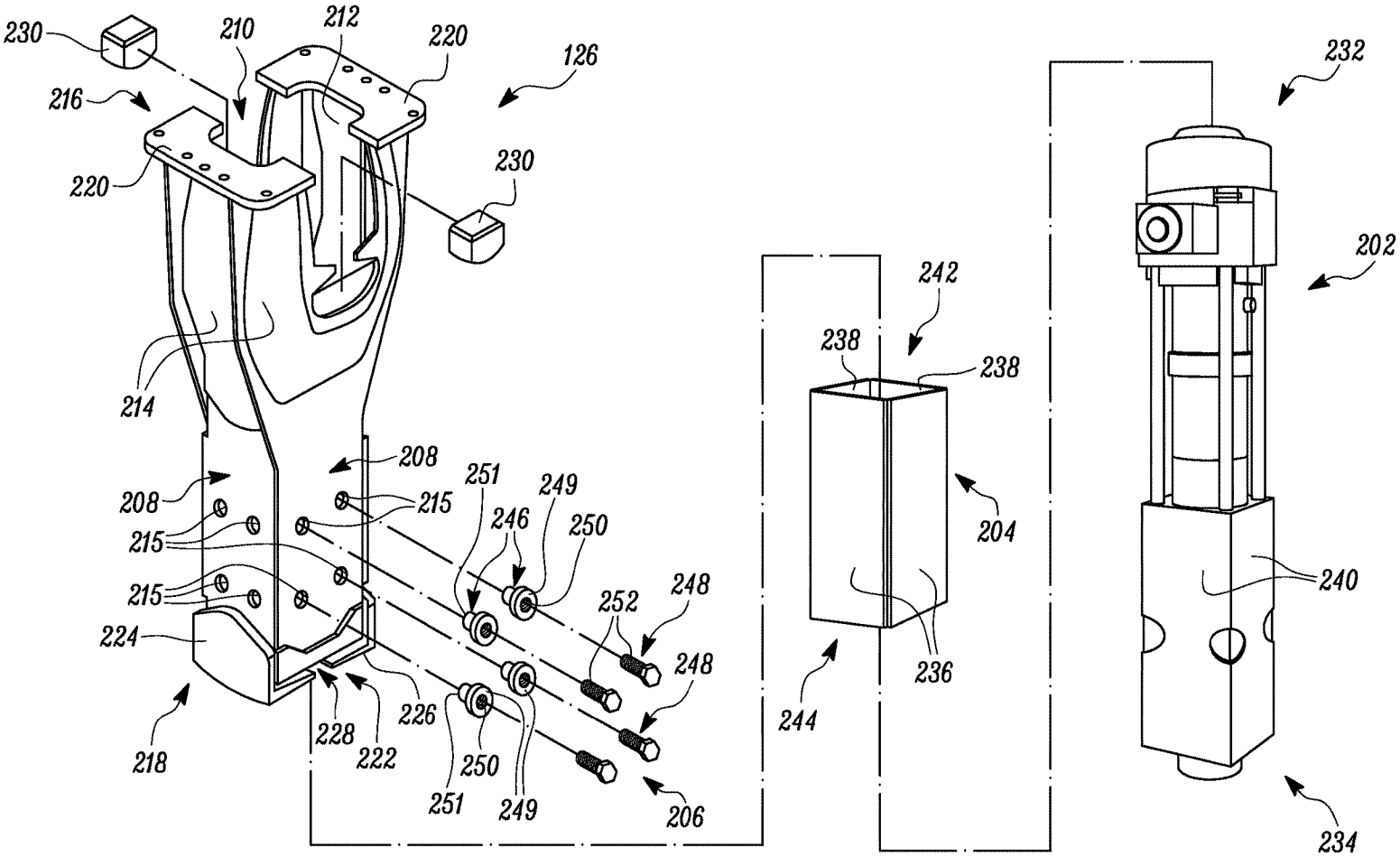
FIG. 2 is an exploded view of the hydraulic hammer showing a clearance control system in accordance with the concepts of the present disclosure.

Referring to FIG. 2, the hydraulic hammer 102 includes the power cell 202 disposed within the housing member 126, the wear members 204 disposed between the housing member 126 and the power cell 202, and the clearance control system 206 disposed on the housing member 126.

The housing member 126 includes a number of walls 208 connected to each other and forming a chamber 210 for receiving the wear members 204 and the power cell 202. In an example, the walls 208 may be connected to each other by various connecting methods including, but not limited to, a fastening mechanism, a welding mechanism, and an adhesive joining mechanism. Each of the number of walls 208 further includes an inner surface 212 and an outer surface 214 defining a thickness of the wall 208. The walls 208 include at least one aperture 215 for receiving the clearance control system 206. As shown in FIG. 2, each of the number of walls 208 includes four apertures 215.

The housing member 126 further includes a proximal end 216 and a distal end 218. The proximal end 216 of the housing member 126 is connected to the linkage structure 118 whereas the distal end 218 receives the tool 128 therethrough. The housing member 126 includes a first plate 220 and a second plate 222 disposed at the proximal end 216 and the distal end 218, respectively. At the proximal end 216, the hydraulic hammer 102 is connected to the linkage structure 118 through the first plate 220.

The second plate 222 includes a first rock claw 224 and a second rock claw 226. The first rock claw 224 and the second rock claw 226 provide a surface to engage the tool 128 with the work surface 110 for performing hammering operations. The first rock claw 224 and the second rock claw 226 also protect the distal end 218 of the housing member 126 from any damage during the hammering operation. A recess 228 is provided between the first rock claw 224 and the second rock claw 226 for allowing the tool 128 to extend out of the hydraulic hammer 102 for hammering operations.

The hydraulic hammer 102 includes a pair of buffers 230 mounted on the walls 208 of the housing member 126. The buffers 230 support the power cell 202 disposed in the housing member 126. In an example, one buffer 230 may be disposed on the walls 208 adjacent to the proximal end 216 for supporting the power cell 202 in a vertical direction in the housing member 126.

The power cell 202 includes a first end 232 and a second end 234. The first end 232 is facing the proximal end 216 of the housing member 126 and the second end 234 is connected to the tool 128. In an example, the power cell 202 may include an impact assembly (not shown) for providing an impact or a load to the tool 128 for hitting the work surface 110. The impact assembly may further include a piston and a cylinder compartment surrounding the piston. The piston may move along a predefined axis within the power cell 202.

In a work stroke, the piston may strike the tool 128 disposed near the second end 234 of the power cell 202. On contact, the movement and impact of the piston may be transmitted to the tool 128 causing a shock wave that may further be transmitted to the work surface 110 resulting into fracturing of the work surface 110. In order to retract the tool 128 off the work surface 110 when the hammering operation is completed, the piston may perform a retracting movement known as a return stroke. Therefore, the work stroke and the return stroke of the piston may actuate the tool 128 allowing to engage and disengage from the work surface 110, respectively. Due to the movement of the piston and the tool 128, the power cell 202 may move also with respect to the housing member 126. In order to compensate for the wear that may occur because of the relative movement between the power cell 202 and the housing member 126, the wear members 204 are provided in the hydraulic hammer 102.

The wear members 204 are positioned between the power cell 202 and the housing member 126. A wear member 204 includes a first surface 236 and a second surface 238. As shown, the second surface 238 is substantially parallel to the first surface 236. The first surface 236 and the second surface 238 define a thickness T (shown in FIG. 3 and FIG. 4) of the wear member 204. The wear member 204 is positioned between the power cell 202 and the housing member 126 in such a manner that the first surface 236 is configured to abut the inner surface 212 of the wall 208. In such a position, the second surface 238 is configured to abut an outer surface 240 of the power cell 202. Therefore, the thickness T of the wear member 204 is configured to provide a predefined clearance C (shown in FIG. 3 and FIG. 4) between the second surface 238 and the outer surface 240 of the power cell 202.

The hydraulic hammer 102 includes four wear members 204 as the housing member 126 includes four walls 208. The wear members 204 are plate-shaped and form a hollow cuboid with an open top end 242 and an open bottom end 244, when connected to each other. As a result, the wear members 204 are in alignment with the shape of the housing member 126 and the power cell 202. In an example, the wear members 204 may be connected to each other by various joining mechanisms, such as a fastening mechanism, a welding mechanism, and an adhesive joining mechanism.

The hydraulic hammer 102 includes the clearance control system 206 for controlling the predefined clearance C between the wear member 204 and the power cell 202. The clearance control system 206 is disposed on the housing member 126. In particular, the clearance control system 206 is disposed on the outer surface 214 of the walls 208 of the housing member 126. The clearance control system 206 is received in the apertures 215 of the walls 208 of the housing member 126.

The clearance control system 206 includes a mounting boss 246 and a fastening member 248. The mounting boss 246 includes a threaded hole 250 for receiving the fastening member 248. The threaded hole 250 extends from an outer surface 249 to an inner surface 251 of the mounting boss 246. In an example, the mounting boss 246 may be disposed on the housing member 126 by using joining techniques that include, but are not limited to, welding, fastening, and adhesive attaching. In another example, the mounting boss 246 may be disposed on the housing member 126 by using a bolt and a nut.

The fastening member 248 is movable within the threaded hole 250 of the mounting boss 246. The fastening member 248 includes threads 252 defined on an outer surface thereof for engaging with a threaded portion 308 of the threaded hole 250. In one example, the mounting boss 246 and the fastening member 248 may be made of a metal, a non-metal, or an alloy material based on the operational characteristics of the clearance control system 206. The operational characteristics may include, but are not limited to a working temperature of the hydraulic hammer 102, environmental factors, a nature of operation to be performed by the hydraulic hammer 102, and dimensions of the hydraulic hammer 102.

A number of wear members 204 to be used may vary based on the operational characteristics of the hydraulic hammer 102. Similarly, shape and size of the wear members 204 may also vary based on the operational characteristics of the hydraulic hammer 102. In one example, the number, the shape, and the size of the wear members 204 may be determined based on a number, a shape, and a size of the walls 208 of the housing member 126.

Figure 3:
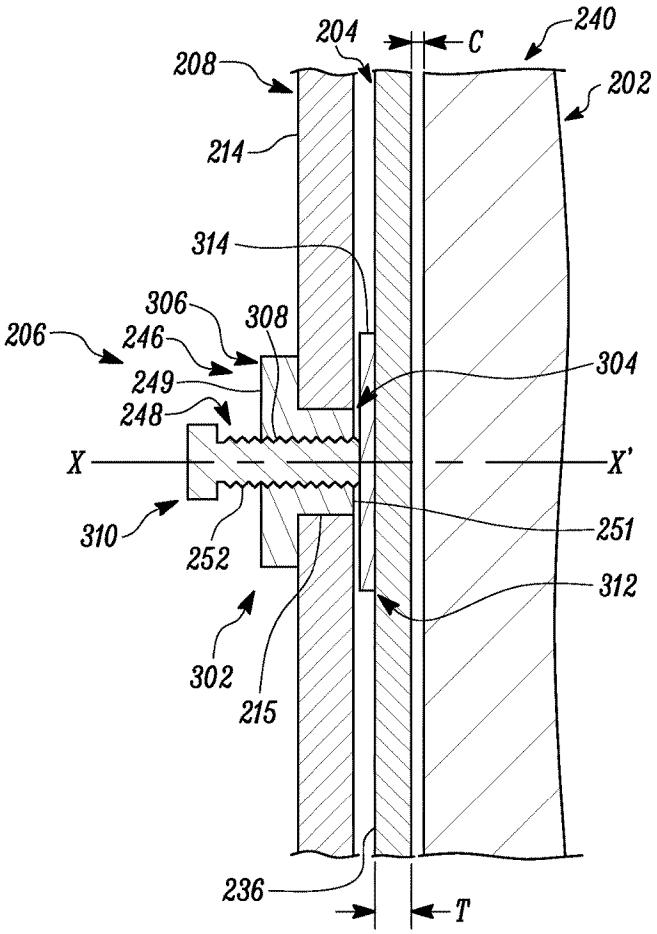
FIG. 3 is a partial sectional view of the clearance control system of the hydraulic hammer, in accordance with the concepts of the present disclosure.
Figure 4:
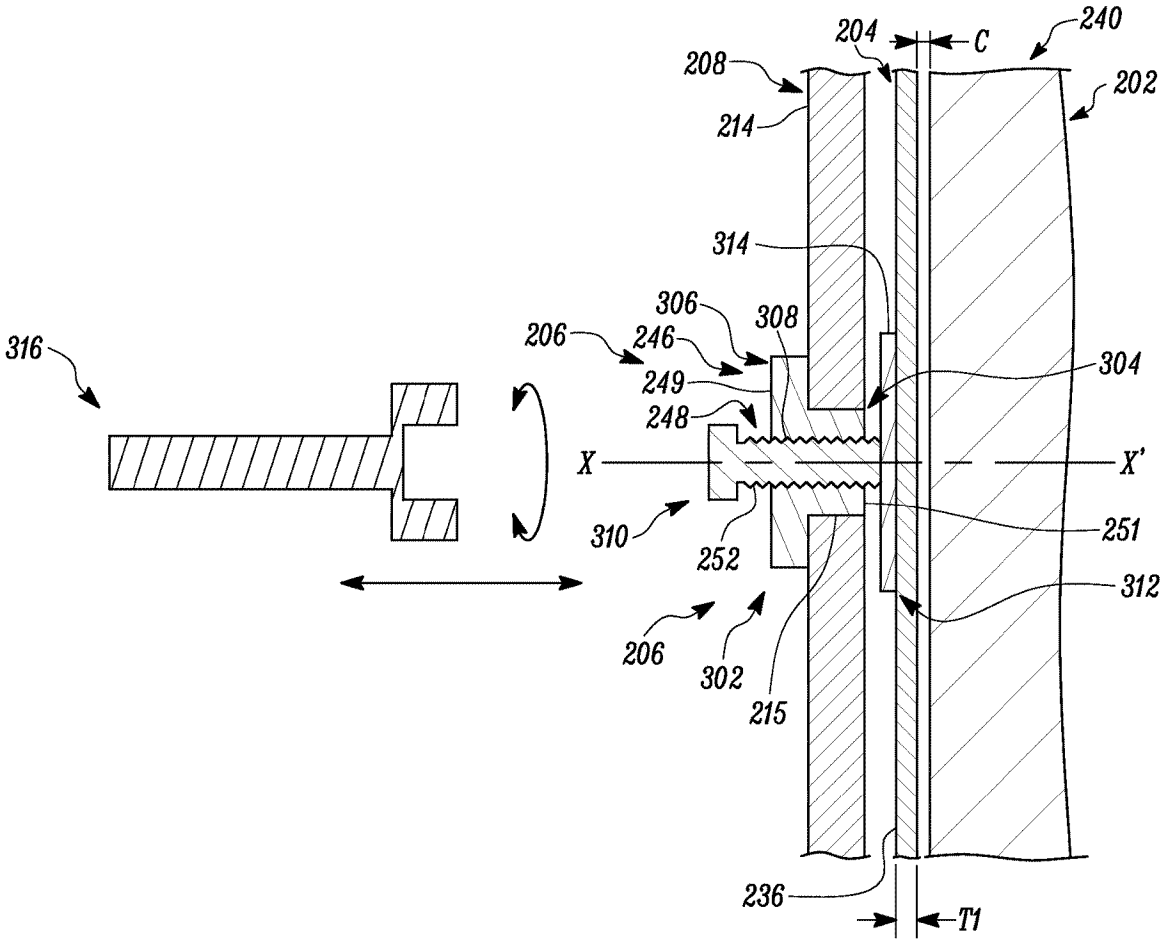
FIG. 4 is a partial sectional view of the clearance control system with a worn-off wear member and an adjustment of the clearance control system, in accordance with the concepts of the present disclosure.

Referring to FIG. 3 and FIG. 4, the clearance control system 206 including the mounting boss 246 and the fastening member 248, is disposed on each wall 208 of the housing member 126. As shown, the clearance control system 206 is disposed in the aperture 215 defined on the outer surface 214 of the housing member 126.

The mounting boss 246 of the clearance control system 206 is a cylindrical component with the threaded hole 250. The mounting boss 246 is disposed in the aperture 215 for providing a passage for the insertion of the fastening member 248. The mounting boss 246 is inserted in the aperture 215 formed on the wall 208 of the housing member 126. In one example, the mounting boss 246 may be disposed in the aperture 215 by using one of a welding technique, a fastening technique, and an adhesive attachment technique. The mounting boss 246 and the aperture 215 are coaxially positioned. The mounting boss 246 includes a first end 302 and a second end 304 distal to the first end 302 along the length of the mounting boss 246. The mounting boss 246 includes a flange portion 306 formed adjacent to the first end 302. The flange portion 306 defines a flat portion configured to abut the outer surface 214 of the wall 208 of the housing member 126. The threaded hole 250 of the mounting boss 246 includes the threaded portion 308 to engage the fastening member 248.

The fastening member 248 includes a first end 310 and a second end 312 distal to the first end 310. The first end 310 receives an input from an operator for operating the clearance control system 206. In one example, the fastening member 248 may include, but is not limited to a bolt, a screw, a nut, a stud, a threaded insert, and a threaded rod. The first end 310 of the fastening member 248 may be a bolt head known in the art.

The second end 312 of the fastening member 248 is configured to contact with the first surface 236 of the wear member 204. The second end 312 includes a flat surface 314 which remains in contact with the first surface 236 of the wear member 204. The flat surface 314 may be understood as a cushion for distributing the force, applied by inserting the fastening member 248 towards the wear member 204, along the first surface 236 of the wear member 204. The threads 252 of the fastening member 248 engage with the threaded portion 308 of the mounting boss 246. Upon receiving the input from the operator, the fastening member 248 travels along a central axis XX'. The fastening member 248 and the mounting boss 246 are disposed in such a manner that the predefined clearance C is maintained between the wear member 204 and the power cell 202.

Referring to FIG. 4, the wear member 204 is worn off and therefore, the clearance between the wear member 204 and the power cell 202 deviates from the predefined clearance C. For example, the clearance is greater than the predefined clearance C. In such a case, the operator provides the input by rotating the fastening tool 316 and in turn the fastening member 248 in the clockwise direction. The operator uses a fastening tool 316 for driving the fastening member 248 in and out of the mounting boss 246. The fastening tool 316 is selected depending on a shape of the first end 310 of the fastening member 248. The fastening tool 316 engages with the first end 310 of the fastening member 248 and moves the fastening member 248 within the threaded hole 250 of the mounting boss 246, based on a clock wise or an anti-clockwise rotation of the fastening member 248.

Upon receiving the input, the fastening member 248 moves along the central axis XX' in a forward direction. Therefore, the fastening member 248 moves towards the wear member 204 through the threaded hole 250 of the mounting boss 246. As a result, the second end 312 of the fastening member 248 contacts with the wear member 204 and pushes the wear member 204 towards the power cell 202. The operator provides the input till the predefined clearance 'C' between the wear member 204 and the power cell 202 is achieved.

Further, when the operator rotates the fastening tool 316 and in turn the fastening member 248 in the anticlockwise direction, the fastening member 248 moves away from the wear member 204 along the central axis XX'. In one example, the fastening member 248 may be rotated in the anti clockwise direction by the operator when the wear member 204 has to be replaced. The clearance between the wear member 204 and the power cell 202 may be kept greater than or lesser than the predefined clearance C based on the movement of the fastening member 248. Therefore, by moving the fastening member 248 in the forward direction and the backward direction along the central axis XX', the predefined clearance C between the wear member 204 and the power cell 202 is controlled.

INDUSTRIAL APPLICABILITY

The present disclosure relates to the hydraulic hammer 102 with the clearance control system 206. The clearance control system 206 is configured to control the predefined clearance 'C' between the wear members 204 and the power cell 202. For controlling the predefined clearance 'C', the clearance control system 206 includes the mounting boss 246 and the fastening member 248. The fastening member 248 is configured to be disposed in the threaded hole 250 of the mounting boss 246. The clearance control system 206 may be disposed on one or more walls 208 of the housing member 126 of the hydraulic hammer 102, based on an operating condition of the wear members 204 disposed near the walls 208. The clearance control system 206 may be employed in any machine that includes moving components, for controlling the predefined clearance created between two moving components due to wear.

With the present disclosure, the hydraulic hammer 102 with the clearance control system 206 ensures that an appropriate clearance is maintained between the wear member 204 and the power cell 202. The clearance can be compensated by moving the wear members 204 towards or away from the power cell 202. Therefore, the clearance control system 206 offers a simple technique for controlling the predefined clearance 'C' between the wear members 204 and the power cell 202. The inconvenience related with the frequent replacement of the wear members 204 is eliminated as the service life of the wear members 204 has increased. The operational cost of the hydraulic hammer 102 is also reduced. Therefore, the present disclosure offers the hydraulic hammer 102 with the clearance control system 206 that is simple, effective, easy to use, economical, and time-saving.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A hydraulic hammer comprising:

a housing member;

a power cell disposed within the housing member;

a wear member disposed between the housing member and the power cell, the wear member comprising:

a first surface configured to abut an inner surface of the housing member; and a second surface distal to the first surface, the second surface configured to abut an outer surface of the power cell, wherein the wear member comprises a thickness extending between the first surface and the second surface, and wherein the thickness of the wear member is configured to provide a predefined clearance between the second surface of the wear member and the outer surface of the power cell; and a clearance control system disposed on the housing member, the clearance control system configured to control the predefined clearance between the wear member and the power cell based on the thickness of the wear member, the clearance control system comprising:

a mounting boss disposed on the housing member and comprising a threaded hole extending from an outer surface to an inner surface of the mounting boss; and a fastening member disposed within the threaded hole of the mounting boss, the fastening member comprising:

a first end configured to receive an input from an operator; and a second end configured to contact with the first surface of the wear member, wherein the fastening member moves along a central axis defined by the threaded hole of the mounting boss to move the wear member towards the power cell, based on the input from the operator, to control the predefined clearance between the wear member and the power cell.

* * * * *